US006165676A

United States Patent [19]

Hattori

[11] Patent Number: 6,165,676

[45] Date of Patent: Dec. 26, 2000

[54] LIGHT SENSITIVE COMPOSITION, IMAGE FORMING MATERIAL AND IMAGE FORMING MATERIAL MANUFACTURING METHOD

[75] Inventor: Ryoji Hattori, Hino, Japan

[73] Assignee: Konica Corporation, Tokyo, Japan

[21] Appl. No.: 09/061,349

[22] Filed: Apr. 16, 1998

[30] Foreign Application Priority Data

Apr. 22, 1997 [JP] Japan ..... 9-104572

[51] Int. Cl.[7] ..... G03C 1/73

[52] U.S. Cl. ..... 430/270.1; 430/905; 430/906; 430/283.1; 430/286.1

[58] Field of Search ..... 430/220.1, 927, 430/905, 906

[56] References Cited

U.S. PATENT DOCUMENTS

| | | | |
|---|---|---|---|
| 4,504,567 | 3/1985 | Yamamoto et al. | 430/270 |
| 5,106,673 | 4/1992 | Effenberger et al. | 430/216 |
| 5,198,317 | 3/1993 | Osawa et al. | 430/58 |
| 5,219,700 | 6/1993 | Nakai et al. | 430/191 |
| 5,314,786 | 5/1994 | Roeschert et al. | 430/270.1 |
| 5,340,699 | 8/1994 | Haley et al. | 430/302 |
| 5,585,220 | 12/1996 | Breyta et al. | 430/270.1 |
| 5,712,078 | 1/1998 | Huang et al. | 430/270.1 |
| 5,728,442 | 3/1998 | Noguchi et al. | 428/65.3 |
| 5,858,604 | 1/1999 | Takeda et al . | 430/162 |
| 5,876,900 | 3/1999 | Watanabe et al. | 430/288.1 |
| 5,919,601 | 7/1999 | Nguyen e al. | 430/278.1 |
| 5,932,392 | 8/1999 | Hirai et al. | 430/270.1 |
| 6,051,361 | 4/2000 | Hattori et al. | 430/270.1 |

*Primary Examiner*—Janet Baxter
*Assistant Examiner*—Yvette M. Clarke
*Attorney, Agent, or Firm*—Frishauf, Holtz, Goodman, Langer & Chick, P.C.

[57] ABSTRACT

Disclosed is a light sensitive composition containing a compound capable of generating an acid on exposure of an actinic light, a compound having a chemical bond capable of being decomposed by an acid or a compound having a group cross-linking by an acid, an infrared absorber, and a solvent mixture of a first solvent with a viscosity of 1.5 cp or more and a second solvent with a viscosity of less than 1.5 cp.

9 Claims, No Drawings

LIGHT SENSITIVE COMPOSITION, IMAGE FORMING MATERIAL AND IMAGE FORMING MATERIAL MANUFACTURING METHOD

FIELD OF THE INVENTION

The present invention relates to a light sensitive composition including a positive working light sensitive composition capable of being solubilized by actinic light irradiation or a negative working light sensitive composition capable of being insolubilized by actinic light irradiation, an image forming material employing the composition and its manufacturing method. The present invention relates particularly to a light sensitive composition, which is suitable for an image forming material capable of being exposed to infrared rays such as a semiconductor laser to form an image, an image forming material employing the composition and its manufacturing method.

BACKGROUND OF THE INVENTION

As an image forming material (hereinafter referred to also as a light sensitive material) comprising a positive working light sensitive layer to be solubilized by actinic light irradiation, an image forming material comprising a light sensitive layer containing an acid generating compound and an acid decomposable compound is known. That is, a light sensitive composition containing an acid generating compound and a water insoluble compound having a specific group capable of decomposed by an acid is disclosed in U.S. Pat. No. 3,779,779, a light sensitive composition containing an acid generating compound and a compound having an acetal or a ketal in the main chain is disclosed in Japanese Patent O.P.I. Publication No. 53-133429/1978, and a light sensitive composition containing an acid generating compound and a compound having a silylether group is disclosed in Japanese Patent O.P.I. Publication No. 65-37549/1985. These compositions have sensitivity in the ultraviolet range, which are capable of being alkali solubilized by imagewise ultraviolet ray exposure to provide non-image portions at exposed portions and to provide image portions at non-exposed portions. The imagewise ultraviolet ray exposure is generally carried out through a mask film by employing ultraviolet rays emitted from a light source such as a halogen lamp or a high pressure mercury lamp, or can be carried out by employing a short wavelength laser such as an argon laser or a helium-cadmium laser. However, these light sources are expensive, and troublesome in using due to its large size. Further, the above described light sensitive materials could not necessarily provide a satisfactory result in view of sensitivity.

In order to increase sensitivity of light sensitive materials, a positive working light sensitive material comprising a mixture of solvents different in viscosity is disclosed in Japanese Patent O.P.I. Publication No. 8-320556, and a positive working light sensitive material comprising a light sensitive compound, its good solvent and its poor solvent is disclosed in Japanese Patent O.P.I. Publication No. 8-328245. However, the imagewise exposure employing ultraviolet rays still has the problems as described above. A simple and less expensive exposure method has been eagerly sought.

A technique for forming an image by irradiation of infrared rays such as a cheap and compact semiconductor laser is proposed. In U.S. Pat. No. 5,340,699 is disclosed an image forming material comprising a light sensitive layer containing an acid generating compound, a resol resin, a novolak resin and an infrared absorber, wherein a negative image is formed by a method comprising imagewise exposing the material to infrared rays, heating the exposed material before development, and then developing the heated material, or a positive image is formed by a method comprising imagewise exposing the material to infrared rays, and then developing the exposed material without heating. However, the method forming a negative image requires the heat treatment, resulting in much electrical power consumption or more load to the processor. The method forming a positive image has a problem in that the light sensitive layer contains much of a residual solvent and the light sensitive layer at image portions is likely to be partially or entirely dissolved in a developer. For example, when a presensitized planographic printing plate (one embodiment of the image forming material of the invention) comprising the above described light sensitive layer is imagewise exposed to infrared rays and developed with a developer, the layer at image portions may be damaged by the developer, although the damage depends upon the concentration of the developer. That is, there may occur a phenomenon called "layer damage", which is caused due to low resistance of the layer to developer. Further, the developed plate (printing plate), which is obtained from the presensitized planographic printing plate, has a problem in that the light sensitive layer at image portions may be damaged by chemicals used during printing due to low resistance to chemicals used during printing. Furthermore, the conventional image forming material is not satisfactory in view of storage stability.

SUMMARY OF THE INVENTION

The present invention has been made in view of the above.

A first object of the invention is to provide an image forming material with high sensitivity to infrared rays, which is capable of being imagewise exposed to infrared rays to form a positive or negative image, and its manufacturing method.

A second object of the invention is to provide an image forming material having excellent developability and excellent storage stability, and its manufacturing method.

A third object of the invention is to provide an image forming material providing a printing plate with excellent resistance to chemicals used during printing.

DETAILED DESCRIPTION OF THE INVENTION

The present inventor has made an extensive study on a light sensitive composition sensitive to infrared rays, and an image forming material with excellent developability and excellent storage stability, comprising a light sensitive layer containing the composition, which are capable of imagewise exposed to infrared rays to from an image. As a result, the present inventor has found that the light sensitive layer strength is improved due to the component constitution or the residual solvent contained in the light sensitive layer, and has completed the present invention.

The above object of the invention can be attained by the followings:

1. a light sensitive composition comprising a compound capable of generating an acid on exposure of an actinic light, a compound having a chemical bond capable of being decomposed by an acid or a compound cross-linking by an acid, an infrared absorber, and a solvent mixture of a first solvent (hereinafter referred to also as solvent A) with a viscosity of 1.5 cp or more and a second solvent (hereinafter referred to also as solvent B) with a viscosity of less than 1.5 cp, 2. the light sensitive composition of item 1, wherein the first solvent has a viscosity of 1.5 cp to 4.0 and the second solvent has a viscosity of less than 0.5 to 1.5 cp,
3. the light sensitive composition of item 1, wherein the solubility parameter, sp value of the solvent mixture is 8.0 or more,
4. the light sensitive composition of item 1, wherein the solubility parameter, sp value of the solvent mixture is 8.5 to 12.0,
5. the light sensitive composition of item 1, wherein the solubility parameter, sp value of the solvent mixture is 9.0 to 11.5,
6. the light sensitive composition of item 1, further comprising a binder,
7. the light sensitive composition of item 6, wherein the binder comprises a novolak resin and a polymer containing a structural unit represented by formula (5):

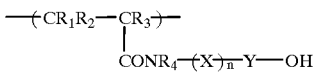

wherein $R_1$ and $R_2$ independently represent a hydrogen atom, an alkyl group or a carboxyl group; $R_3$ represents a hydrogen atom, a halogen atom or an alkyl group; $R_4$ represents a hydrogen atom, an alkyl group, an aryl group or a naphthyl group; Y represents a substituted or unsubstituted phenylene or naphthylene group; X represents a divalent linkage group; and n is an integer of 0 to 5, 8. an image forming material comprising a support and provided thereon, a light sensitive layer comprising a light sensitive composition containing a compound capable of generating an acid on exposure of an actinic light, a compound having a chemical bond capable of being decomposed by an acid or a compound having a group cross-linking by an acid, an infrared absorber, and a solvent mixture of a first solvent with a viscosity of 1.5 cp or more and a second solvent with a viscosity of less than 1.5 cp,
9. the image forming material of item 8, wherein the residual solvent content of the light sensitive layer is 5 $mg/m^2$ or less,
10. the image forming material of item 9, wherein the residual solvent content of the light sensitive layer is 0.01 to 5 $mg/m^2$, or
11. a method of manufacturing an image forming material, the method comprising the steps of coating the light sensitive composition as described in item 1 or 2 on an aluminum support, and drying the coated material at 85° C. or more for 10 seconds or more.

The present invention will be detailed below.

The light sensitive composition, the image forming material and its manufacturing method of the invention will be explained in that order below.

(1) Light Sensitive Composition

The light sensitive composition of the invention is divided into two types, a negative working light sensitive composition and a positive working light sensitive composition according to its working function. The light sensitive composition of the invention (positive working) comprises a compound generating an acid by active light irradiation, a compound having a chemical bond capable of being decomposed by an acid, an infrared absorber, and a solvent mixture of a solvent (hereinafter referred to as solvent A) with a viscosity of 1.5 cp or more and a solvent (hereinafter referred to as solvent B) with a viscosity of less than 1.5 cp.

The light sensitive composition of the invention (negative working) comprises a compound generating an acid by active light irradiation, a compound having a group capable of being cross-linked by an acid, an infrared absorber, and a solvent mixture of solvent A and solvent B.

Solvent

The solvent used in the invention will be explained below.

Solvent A has a viscosity of 1.5 cp or more, preferably 1.5 to 4.0 cp, and more preferably 1.5 to 3.5 cp. Solvent A includes n-propanol, isopropyl alcohol, n-butanol, sec-butanol, isobutanol, 2-methyl-1-butanol, 3-methyl-1-butanol, 2-methyl-2-butanol, 2-ethyl-1-butanol, 1-pentanol, 2-pentanol, 3-pentanol, n-hexanol, 2-hexanol, cyclohexanol, methylcyclohexanol, 1-heptanol, 2-heptanol, 3-heptanol, 1-octanol, 4-methl-2-pentanol, 2-hexylalcohol, benzyl alcohol, ethylene glycol, diethylene glycol, triethylene glycol, tetraethylene glycol, 1,3-propane diol, 1,5-pentane glycol, dimethyl triglycol, furfuryl alcohol, hexylene glycol, hexyl ether, 3-methoxy-1-methylbutanol, butyl phenyl ether, ethylene glycol monoacetate, propylene glycol monomethylether, propylene glycol monoethylether, propylene glycol monopropylether, propylene glycol monobutylether, propylene glycol phenylether, dipropylene glycol monomethylether, dipropylene glycol monoethylether, dipropylene glycol monopropylether, dipropylene glycol monombutylether, tripropylene glycol monomethylether, methyl carbitol, ethyl carbitol, ethyl carbitol acetate, butyl carbitol, triethylene glycol monomethylether, triethylene glycol monoethylether, tetraethylene glycol dimethylether, diacetone alcohol, acetophenone, cyclohexanone, methyl cyclohexanone, acetonylacetone, isophorone, methyl lactate, ethyl lactate, butyl lactate, propylene carbonate, phenyl acetate, sec-butyl acetate, cyclohexyl acetate, diethyl oxalate, methyl benzoate, ethyl benzoate, γ-butyrolactone, 3-methoxy-1-butanol, 4-methoxy-1-butanol, 3-ethoxy-1-butanol, 3-methoxy-3-methyl-1-butanol, 3-methoxy-3-ethyl-1-pentanol, 4-ethoxy-1-pentanol, 5-methoxy-1-hexanol, 4-hydroxy-2-pentanone, 5-hydroxy-2-pentanone, 4-hydroxy-3-pentanone, 6-hydroxy-2-pentanone, 6-hydroxy-2-hexanone, 3-methyl-3-hydroxy-2-pentanone, methyl cellosolve (MC), and ethyl cellosolve (EC).

Solvent B has a viscosity of less than 1.5 cp, preferably 0.5 to less than 1.5 cp, and more preferably 0.8 to less than 1.5 cp. Solvent B includes allyl alcohol, isopropyl ether, butyl ether, anisole, propylene glycol monomethylether acetate, diethyl carbitol, tetrahydro furane, dioxane, dioxolane, acetone, methylpropyl ketone, methylethyl ketone, methylamyl ketone, diethyl ketone, ethylbutyl ketone, dipropyl ketone, diisobutyl ketone, 3-hydroxy-2-butanone, 4-hydroxy-2-butanone, 2-methoxyethyl acetate, 2-ethoxyethyl acetate, methoxybutyl acetate, methyl propionate, propyl propionate, methyl butyrate, ethyl butyrate, butyl butyrate, N-methyl-2-pyrrolidone, acetonitrile, dimethylformamide (DMF), dimethylacetoamide (DMAc), n-pentane, 2-methylpentane, 3-ethylpentane, methylcyclopentane, n-hexane, isohexane, cyclohexane, methylcyclohexane, n-heptane, cycloheptane, n-octane, isooctane, nonane, decane, benzene, toluene, o-xylene, m-xylene, p-xylene, ethylbenzene, o-diethylbenzene, m-diethylbenzene, p-diethylbenzene, cumene, n-amylbenzene, dimethyl diglycol (DMDG), and ethanol.

The mixture ratio by weight of solvent A to solvent B is 0.1:9.9 to 9.9:0.1, preferably 0.5:9.5 to 9.5:0.5, and more preferably 2:8 to 8:2.

In the invention, the viscosity of the solvent is a viscosity measured at 20° C., and is one as shown in the literature's well known in the art. The literature's include "Shinpan Yozai Pocket Book", Yukigosei Kagakukyokai, published by Ohm Co., Ltd. (Jul. 10, 1994), "Yozai Handbook (Zoteiban)" Vol. 6, published by Sangyotosho Co., Ltd. (Apr. 10, 1970), "Yozai Binran", Vol. 2, published by Maki Shoten (Nov. 15, 1972), and "Kobunshi Data Handbook (Kisohen)" edited by Kobunshi Gakkai. Viscosity of a solvent, which is not described in these literature's, is a value obtained by being measured at 20° C. with a viscometer according to JIS Z8803. The viscosity is an average value of the measured values which fall within ±2%.

The solvents A and B may be used singly or in combination of two or more kinds, respectively. Solvent A is preferably methyl lactate, propylene glycol monomethylether, ethyl lactate, cyclohexanone, or 3-methoxy-1-butanol. Solvent B is preferably methyl ethyl ketone, 4-hydroxy-2-butanone, acetone, dioxolane, or methyl propyl ketone.

A mixture ratio of solvents A and B in the invention is not specifically limited, but solvents A and B are preferably mixed to show a solubility parameter (sp value) of the mixture solvent of 8.0 or more. The sp value of the mixture solvent is preferably 8.5 to 12.0, and more preferably 9.0 to 11.5.

The solubility parameter, which is used in evaluating solubility of a non-electrolyte in an organic solvent, a value obtained by Hilderbrand. The solubility parameter is described in J. H. Hilderbrand, J. M. Prausnitz, R. L. Scott, "Regular and Relanted Solutions", Van Nostyrand-Reinhold, Princeton (1970), or "Kobunshi Data Handbook (Kisohen)" edited by Kobunshi Gakkai. The sp Values of various solvents are described in A. F. M. Baron, "Handbook of Solubility Parameters and Other Cohesion Parameters", CRC Press, Boca Raton, Fla. (1983) or "Kobunshi Data Handbook (Kisohen)" edited by Kobunshi Gakkai.

Components used in the light sensitive composition of the invention will be explained below. (A compound capable of generating an acid on irradiation of an active light)

The compound (hereinafter referred to as the acid generating compound in the invention) capable of generating an acid on irradiation of an active light used in the light sensitive composition of the invention includes various conventional compounds and mixtures. For example, a salt of diazonium, phosphonium, sulfonium or iodonium ion with $BF_4^-$, $PF_6^-$, $SbF_6^-$ $SiF_6^{2-}$ or $ClO_4^-$, an organic halogen containing compound, o-quinonediazide sulfonylchloride or a mixture of an organic metal and an organic halogen containing compound is a compound capable of generating or releasing an acid on irradiation of an active light, and can be used as the acid generating compound in the invention. The organic halogen containing compound known as an photoinitiator capable of forming a free radical forms a hydrogen halide and can be used as the acid generating compound of the invention.

The examples of the organic halogen containing compound capable of forming a hydrogen halide include those disclosed in U.S. Pat. Nos. 3,515,552, 3,536,489 and 3,779,778 and West German Patent No. 2,243,621, and compounds generating an acid by photodegradation disclosed in West German Patent No. 2,610,842. The examples of the acid generating compounds used in the invention include o-naphthoquinone diazide-4-sulfonylhalogenides disclosed in Japanese Patent O.P.I. Publication No. 50-30209.

The preferable acid generating compound in the invention is an organic halogen containing compound in view of sensitivity to infrared rays and storage stability of an image forming material using it. The organic halogen containing compound is preferably a halogenated alkyl-containing triazines or a halogenated alkyl-containing oxadiazoles. Of these, halogenated alkyl-containing s-triazines are especially preferable. The examples of the halogenated alkyl-containing oxadiazoles include a 2-halomethyl-1,3,4-oxadiazole compound disclosed in Japanese Patent O.P.I. Publication Nos. 54-74728, 55-24113, 55-77742/1980, 60-3626 and 60-138539. The preferable examples of the 2-halomethyl-1,3,4-oxadiazole compound are listed below.

A

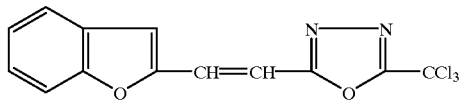

B

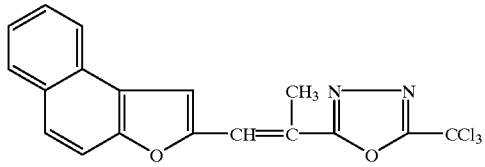

C

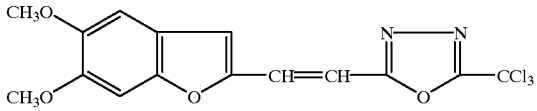

The halogenated alkyl containing triazines are preferably a compound represented by the following formula (1):

formula (1)

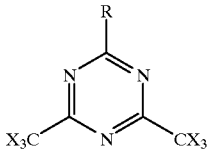

wherein R represents an alkyl group, a halogenated alkyl, an alkoxy group, a substituted or unsubstituted styryl group, or a substituted or unsubstituted aryl group; (for example, phenyl or naphthyl group) and $X_3$ represents a halogen atom.

The examples of an s-triazine acid generating compound represented by formula (1) are listed below.

(1)

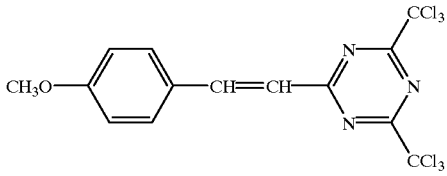

-continued (2)

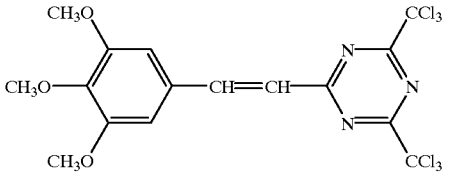

(3)

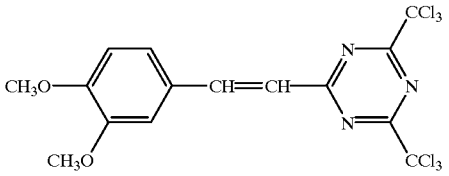

(4)

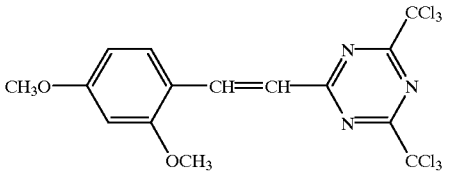

(5)

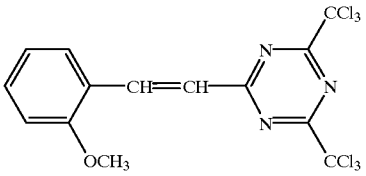

(6)

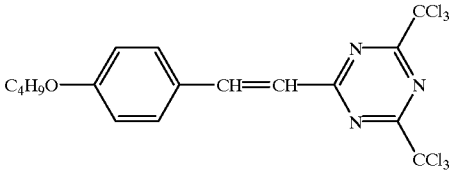

(7)

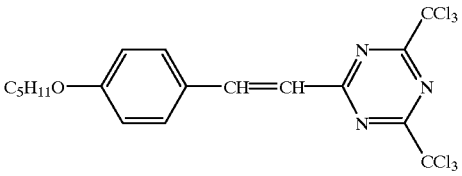

(8)

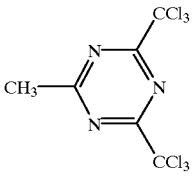

(9)

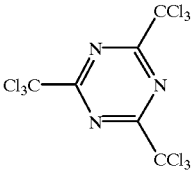

-continued (10)

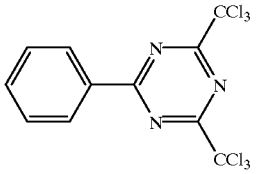

(11)

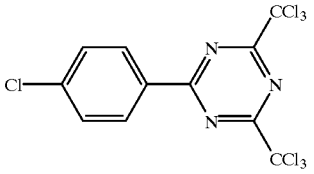

(12)

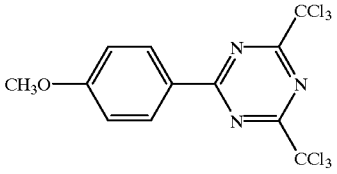

(13)

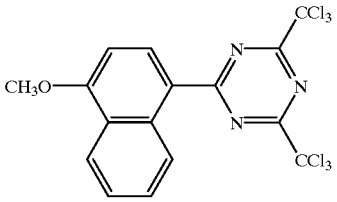

(14)

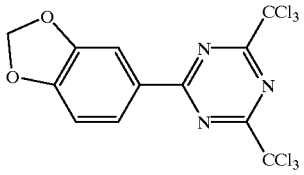

The content of the acid generating compound in the light sensitive composition is preferably 0.1 to 20% by weight, and more preferably 0.2 to 10% by weight based on the total weight of the solid components of the composition, although the content braodly varies depending on its chemical properties, kinds of light sensitive composition used or physical properties of the composition. (Compound having a chemical bond capable of being decomposed by an acid)

The compound (hereinafter referred to also as the acid decomposable compound in the invention) having a chemical bond capable of being decomposed by an acid used in the invention includes a compound having a C—O—C bond disclosed in Japanese Patent O.P.I. Publication Nos. 48-89003/1973, 51-120714/1976, 53-133429/1978, 55-12995/1980, 55-126236/1980 and 56-17345/1981, a compound having a Si—O—C bond disclosed in Japanese Patent O.P.I. Publication Nos. 60-37549/1985 and 60-121446/1985, another acid decomposable compound disclosed in Japanese Patent O.P.I.I. Publication Nos. 60-3625/1985 and 60-10247/1935, a compound having a Si—N bond disclosed in Japanese Patent O.P.I. Publication No. 62-222246/1987, a carbonic acid ester disclosed in Japanese Patent O.P.I. Publication No. 62-251743/1987, an orthocarbonic acid ester disclosed in Japanese Patent O.P.I. Publication No. 62 -2094561/1987, an orthotitanic acid ester disclosed in Japanese Patent O.P.I. Publication No. 62-280841/1987, an orthosilicic acid ester disclosed in Japanese Patent O.P.I. Publication No. 62-280842/1987, an acetal or ketal disclosed in Japanese Patent O.P.I. Publication No. 63-10153/1988 and a compound having a C—S bond disclosed in Japanese Patent O.P.I. Publication No. 62-244038/1987.

Of these compounds, the compound having a C—O—C bond, the compound having a Si—O—C bond, the orthocarbonic acid esters, the acetals or ketals or the silylethers disclosed in Japanese Patent O.P.I. Publication Nos. 53-133429/1978, 56-17345/1981, 60-121446/1985, 60-37549/1985, 62-209451/1987 and 63-10153/1988 are preferable. Of these compounds is especially preferable a polymer disclosed in Japanese Patent O.P.I. Publication No. 53-133429/1978 which has a repeated acetal or ketal group in the main chain and increasing solubility in a developer by action of an acid or a compound capable of being decomposed by an acid disclosed in Japanese Patent O.P.I. Publication No. 63-10153/1988, which has the following structure:

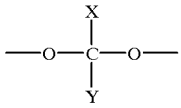

Wherein X represents a hydrogen atom or

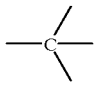

Y represents

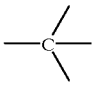

provided that X and Y may be the same or different.

The examples of the acid decomposable compound used in the invention include compounds disclosed in the above described patent specifications and their synthetic method is described in the above described patent specifications.

As the acid decomposable compound in the invention are preferable orthocarbonic acid esters, acetals, ketals or silylethers, each compound having a $—(CH_2CH_2O)_n—$ group in which n is an integer of 1 to 5, in view of sensitivity and developability. Of the compounds having a $—(CH_2CH_2O)_n—$ group, n is especially preferably 1 to 4. The typical example of such a compound includes a condensation product of dimethoxycyclohexane, benzaldehyde or their derivative with diethylene glycol, triethylene glycol, tetraethylene glycol or pentaethylene glycol.

In the invention, the compound represented by the following formula (2) or (2') is preferable as the acid decomposable compound in view of sensitivity and developability.

formula (2)

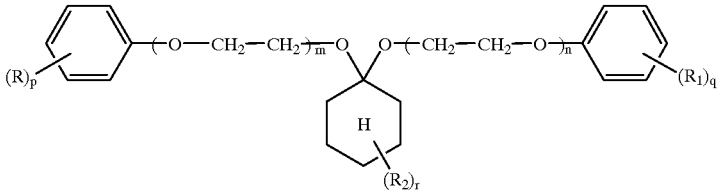

formula (2')

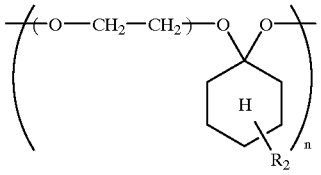

wherein R, $R_1$ and $R_2$ independently represent a hydrogen atom, an alkyl group having 1 to 5 carbon atoms, an alkoxy group having 1 to 5 carbon atoms, a sulfo group, a carboxyl group or a hydroxy group, p, q and r independently represent an integer of 1 to 3, and m and n independently represent an integer of 1 to 5. The alkyl group represented by R, $R_1$ and $R_2$ may be straight chained or branched, and includes a methyl group, an ethyl group, a propyl group, an isopropyl group, a butyl group, a tert-butyl group, and a pentyl group. The alkoxy group represented by R, $R_1$ and $R_2$ includes a methoxy group, an ethoxy group, a propoxy group, an isopropoxy group, a butoxy group, a tert-butoxy group, and a pentoxy group. In the compound represented by formula (2), m and n each especially preferably are 1 to 4. The compound represented by formula (2) or (2') can be prepared according to a conventional synthetic method.

The content of the acid decomposable compound in the light sensitive composition of the invention is preferably 5 to 70% by weight, and more preferably 10 to 50% by weight based on the total solid weight of the light sensitive composition. The acid decomposable compound in the invention can be used singly or in combination.

Compound Having a Group Cross-Linking by an Acid

In the invention, the compound having a group cross-linking by an acid herein referred to is a compound (hereinafter referred to also as a cross-linking agent) cross-linking alkali soluble resins in the presence of an acid. The cross-linking agent cross-links the alkali soluble resin and lowers solubility in the alkali of the cross-linked alkali soluble resin. The alkali solubility lowering extent in the invention is such that the cross-linked alkali soluble resin is insoluble in the alkali. Concretely, when the light sensitive material is imagewise exposed which comprising a light sensitive layer containing the alkali soluble resin and the cross-linking agent on a support, the alkali soluble resin at exposed portions is cross-linked so that the cross-linked resin is insoluble in an alkali solution as a developer, in which the alkali soluble resin before exposure has been soluble in the developer, and the exposed material is developed with the developer to remain the exposed portions on the support. The cross-linking agent includes a compound having a methylol group or a methylol derivative group, a melamine resin, a furan resin, an isocyanate, and a blocked isocyanate (an isocyanate having a protective group). The cross-linking agent is preferably a compound having a methylol group or an acetoxymethyl group. The content of the cross-linking agent is preferably 1 to 80% by weight, and more preferably 5 to 60% by weight based on the total solid weight of the light sensitive composition of the invention.

Infrared Absorber

The infrared absorber used in the invention includes an infrared absorbing dye having an absorption in the wavelength range of 700 nm or more, carbon black and magnetic powder. The especially preferable infrared absorber has an absorption maximum in the wavelength range of 700 nm to 850 nm and having a molar extinction coefficient, $\epsilon$ of $10^5$ or more.

The above infrared absorber includes cyanine dyes, squarylium dyes, chloconium dyes, azulenium dyes, phthalocyanine dyes, naphthalocyanine dyes, polymethine dyes, naphthoquinone dyes, thiopyrilium dyes, dithiol metal complex dyes, anthraquinone dyes, indoaniline metal complex dyes and intermolecular charge transfer complex dyes. The above described infrared absorber includes compounds disclosed in Japanese Patent O.P.I. Publication Nos. 63-139191/1988, 64-33547/1989, 1-160683/1989, 1-280750/1989, 1-293342/1989, 2-2074/1990, 3-26593/1991, 3-30991/1991, 3-34891/1991, 3-36093/1991, 3-36094/1991, 3-36095/1991, 3-42281/1991 and 3-103476/1991.

In the invention, the infrared absorber is especially preferably a cyanine dye represented by the following formula (3) or (4):

formula (3)

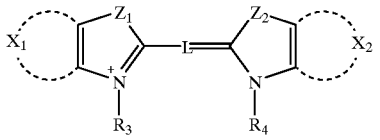

formula (4)

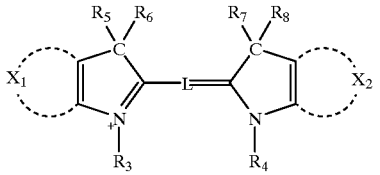

wherein $Z_1$ and $Z_2$ independently represent a sulfur atom, a selenium atom or an oxygen atom; $X_1$ and $X_2$ independently represent a non-metallic atomic group necessary to form a benzene or naphthalene ring, which may have a substituent; $R_3$ and $R_4$ independently represent a substituent, provided that one of $R_3$ and $R_4$ represents an anionic group, $R_5$, $R_6$, $R_7$ and $R_8$ independently represent a hydrogen atom, a halogen atom or an alkyl group having 1 to 3 carbon atoms; and L represents a linkage with a conjugated bond having 5 to 13 carbon atoms.

The cyanine dye represented by formula (3) or (4) includes a cyanine dye in which formula (3) or (4) itself forms a cation in its intramolecule and has an anionic group as a counter ion. The anionic group includes $Cl^-$, $Br^-$, $ClO_4^-$, $BF_4^-$, and an alkyl borate anion such as a t-butyltriphenyl borate anion.

The carbon number (n) in the linkage with a conjugated bond represented by L of formula (3) or (4) is preferably selected to match with wavelength of light emitted from an infrared laser used for exposure as a light source. For example, when a YAG laser, which emits 1060 nm light, is used, n is preferably 9 to 13. The conjugated bond may have a substituent, and may form a ring together with another atomic group. The substituent of the ring represented by $X_1$ or $X_2$ may be any, but is preferably a group selected from the group consisting of a halogen atom, an alkyl group having 1 to 5 carbon atoms, an alkoxy group having 1 to 5 carbon atoms, —$SO_3M$, and —COOM (in which M represents a hydrogen atom or an alkali metal atom). The substituent of $R_3$ and $R_4$ may be any, but is preferably an alkyl group having 1 to 5 carbon atoms, an alkoxy group having 1 to 5 carbon atoms, or —$((CH_2)n—O—)_k—(CH_2)_mOR$ (in which n and m independently represent an integer of 1 to 3, k represents 0 or 1, and R represents an alkyl group having 1 to 5 carbon atoms), or preferably one of $R_3$ and $R_4$ represents —$RSO_3M$, and the other —$RSO_3^-$, in which R represents an alkylene group having 1 to 5 carbon atoms, and M represents an alkali metal atom, or preferably one of $R_3$ and $R_4$ represents —RCOOM, and the other —$RCOO^-$, in which R represents an alkylene group having 1 to 5 carbon atoms, and M represents an alkali metal atom. It is more preferable in view of sensitivity or developability that one of $R_3$ and $R_4$ represents —$RSO_3M$ or —RCOOM, and the other —$RSO_3^-$ or —$RCOO^-$.

When a semiconductor laser is used for exposure as a light source, a dye represented by formula (3) or (4) is preferably a dye having an absorption peak in the range of 750 to 900 nm and a molar extinction coefficient $\epsilon$ exceeding $1\times10^5$, and when a YAG laser is used for exposure as a light source, a dye represented by formula (3) or (4) is preferably a dye having an absorption peak in the range of 900 to 1200 nm and a molar extinction coefficient $\epsilon$ exceeding $1\times10^5$.

The examples of the infrared absorber preferably used in the invention are listed below, but are not limited thereto.

IR1
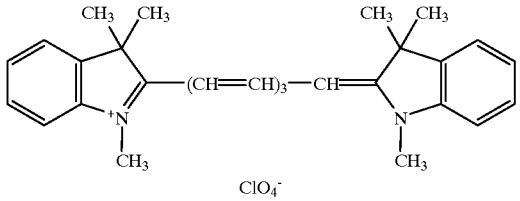
IR2
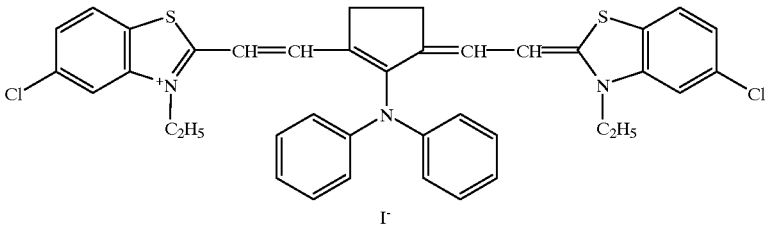
IR3
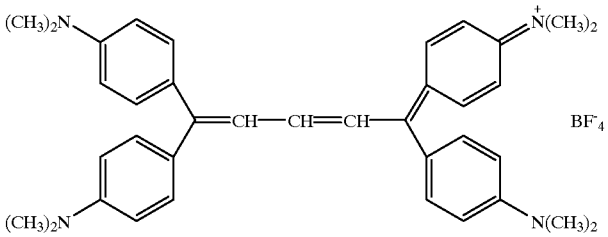
IR4
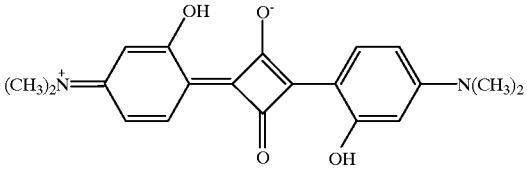
IR5
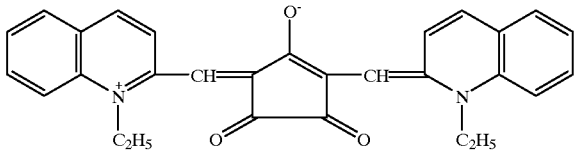
IR6
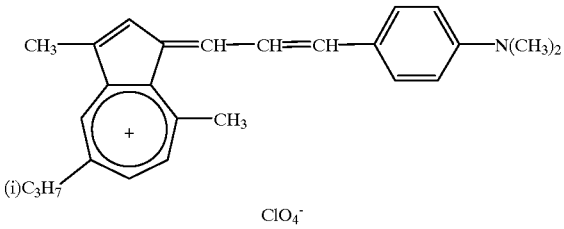
IR7
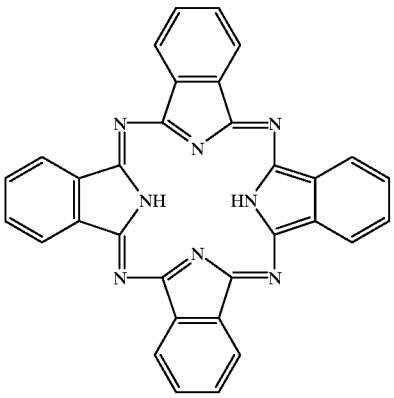
IR8
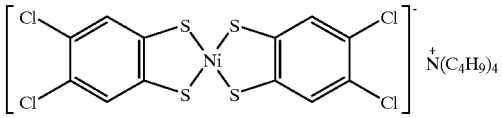
IR9
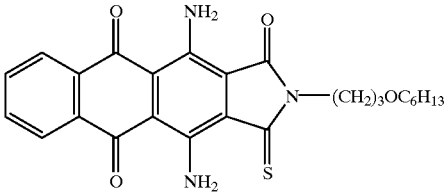

-continued
IR10
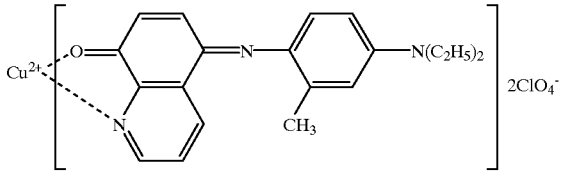
IR11
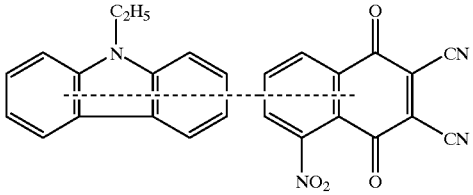
IR12
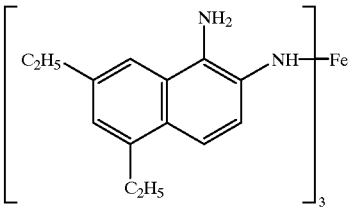
IR13
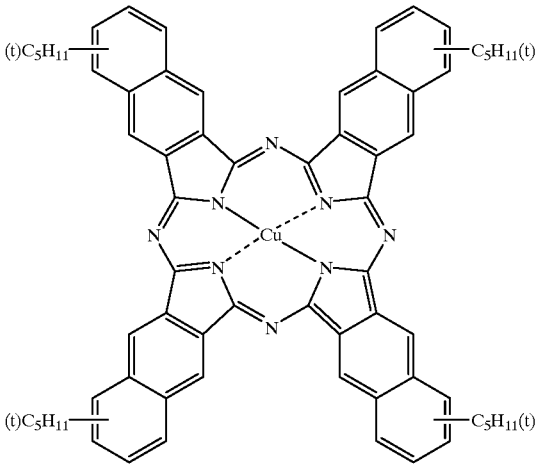
IR14
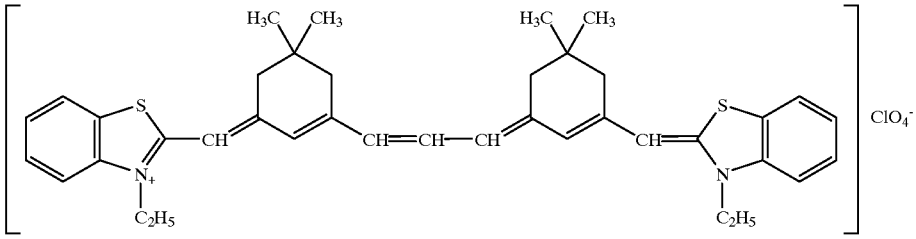
IR15
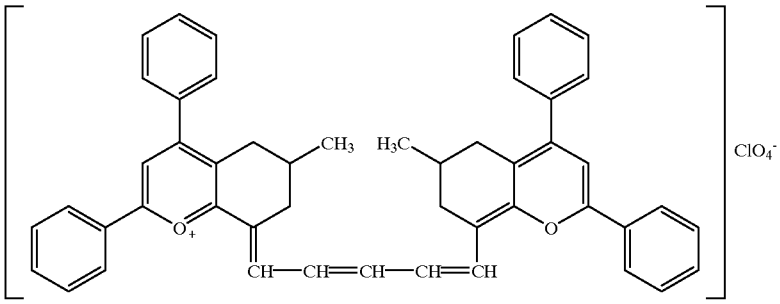

-continued
IR16
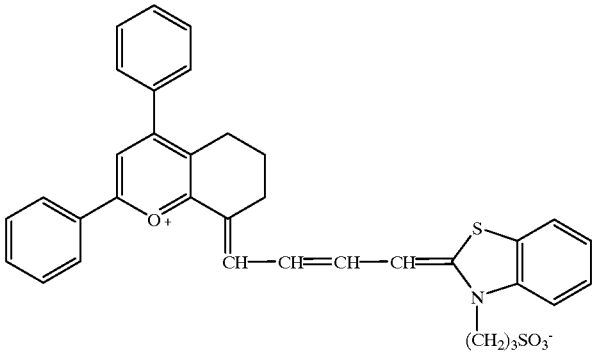
IR17
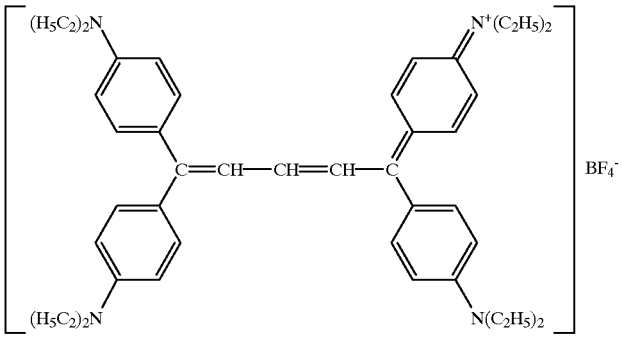
IR18
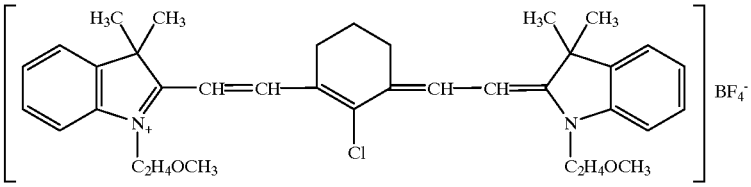
IR19
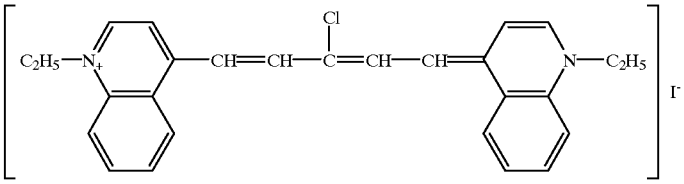
IR20
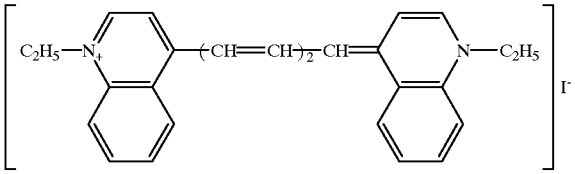
IR21
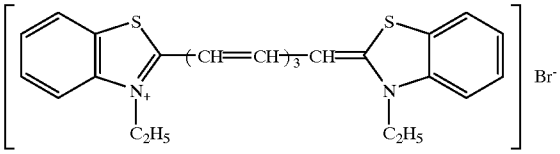
IR22
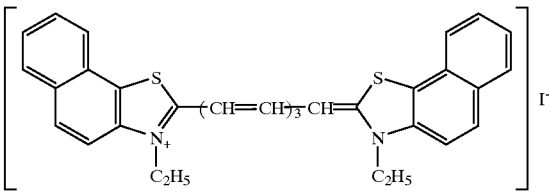
IR23
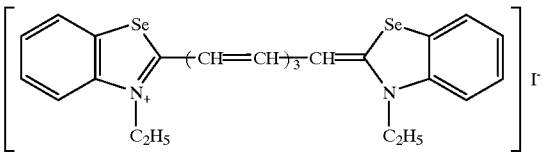

-continued
IR24
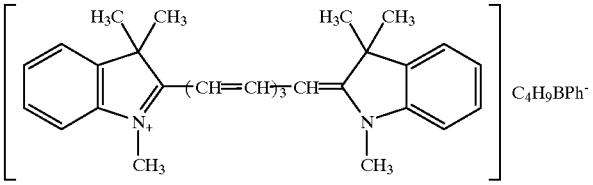
IR25
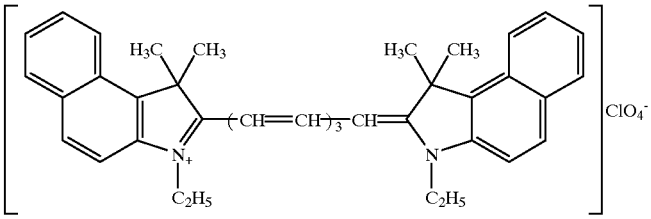
IR26
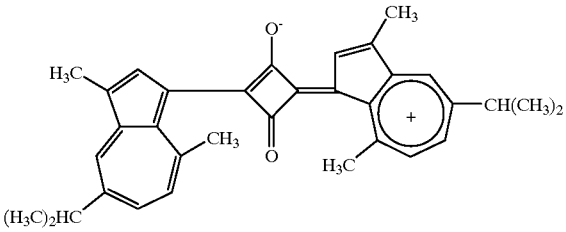
IR27
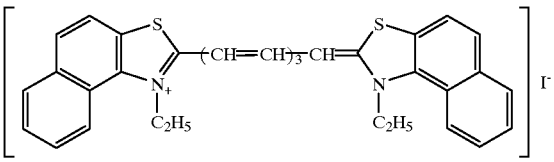
IR28
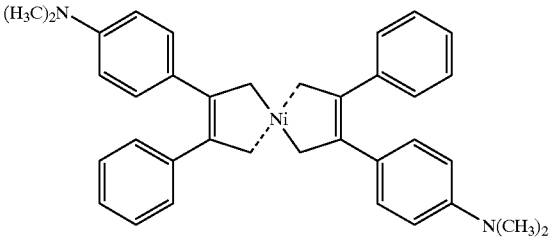
IR29
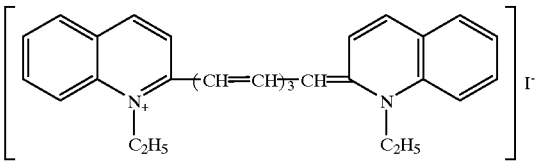
IR30
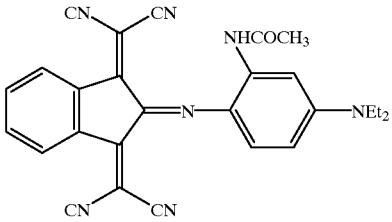
IR31
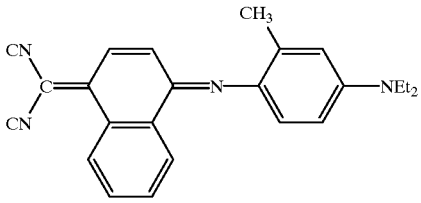
IR32
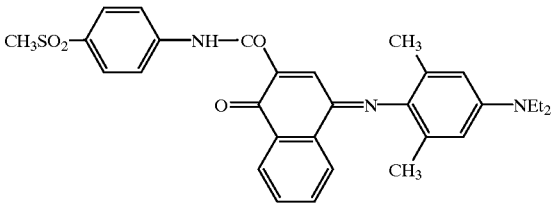
IR33
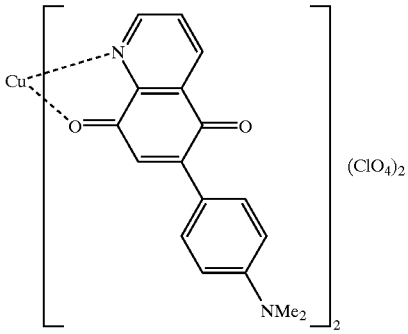

-continued
IR34
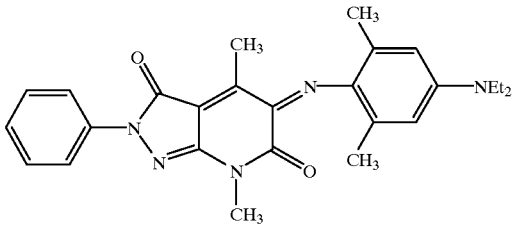
IR35
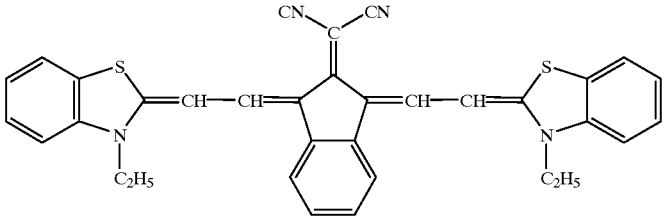
IR36
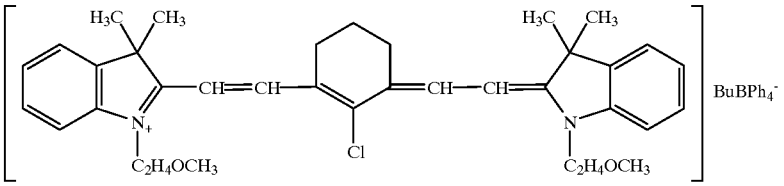
IR37
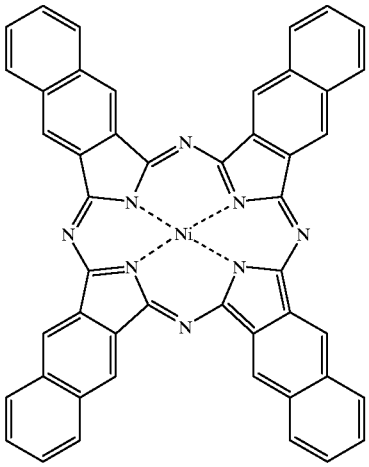
IR38
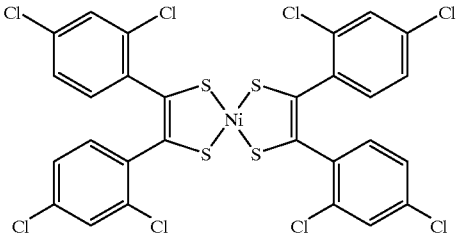
IR39
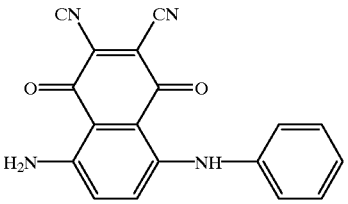
IR40
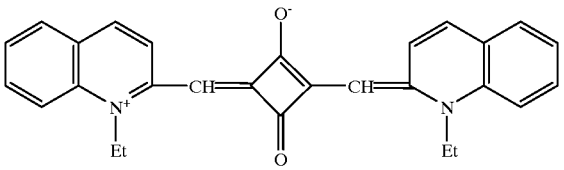
IR41
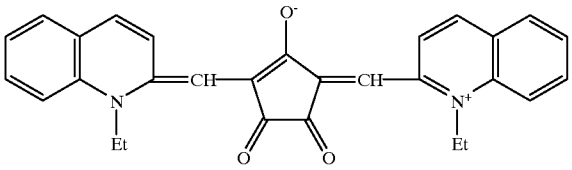

-continued
IR42
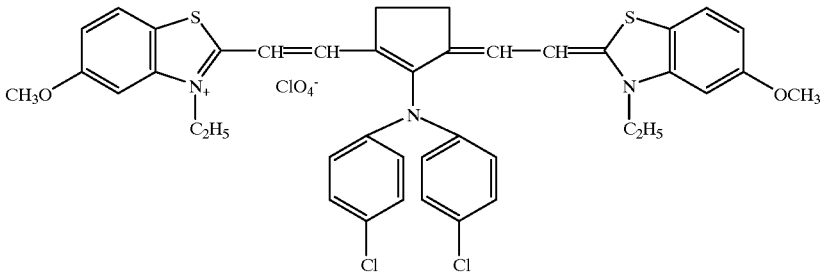
IR43
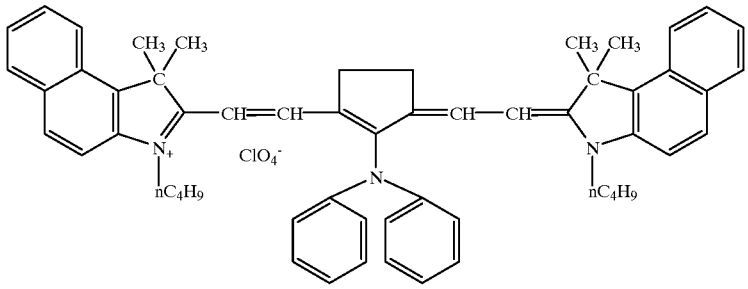
IR44
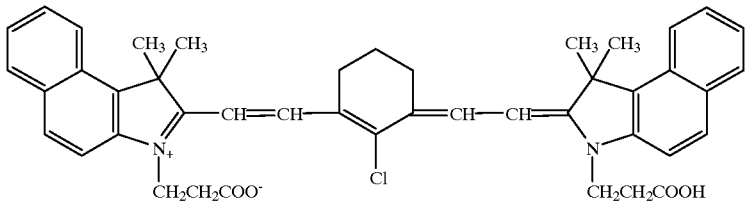
IR45
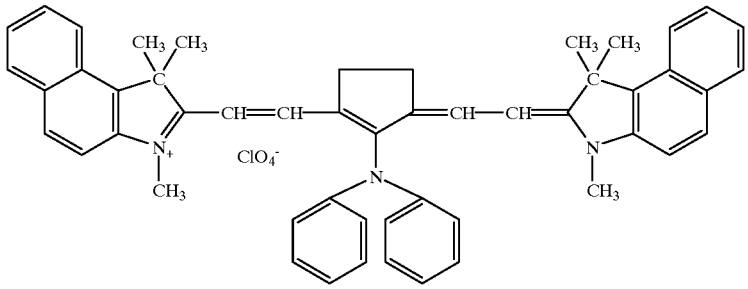
IR46
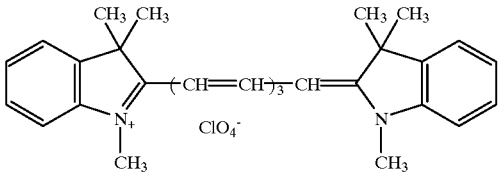
IR47
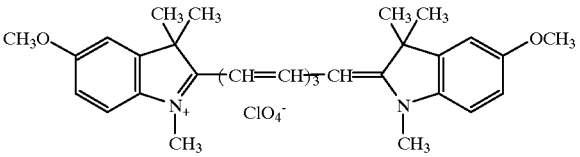
IR48
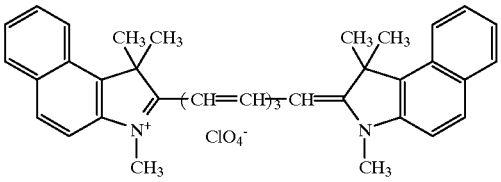
IR49
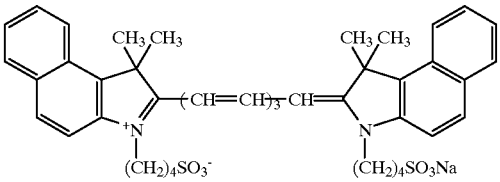

-continued
IR50
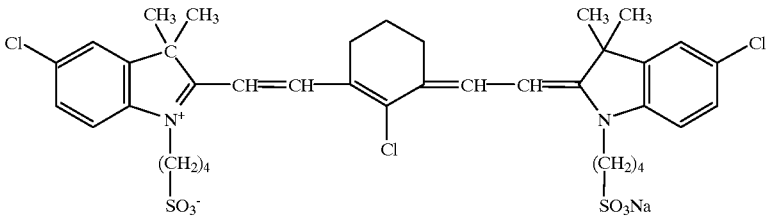
IR51
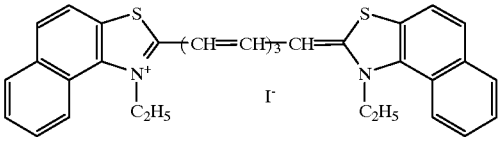
IR52
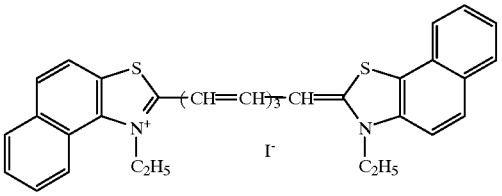
IR53
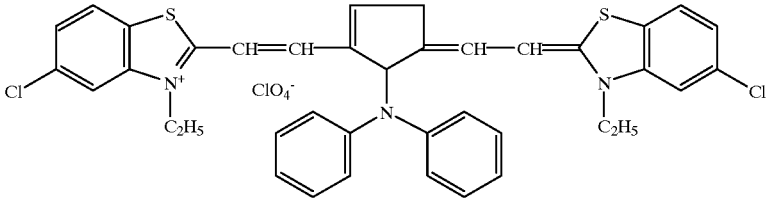
IR54
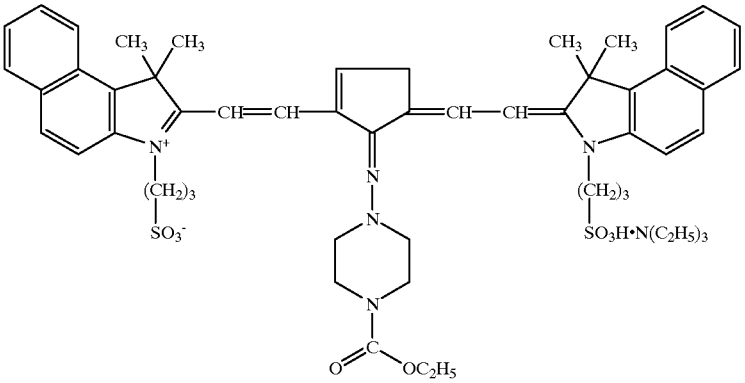
IR55
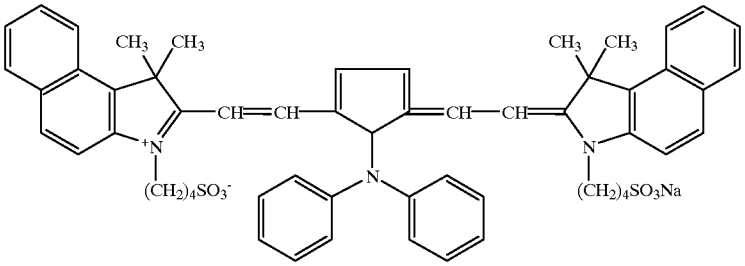
IR56
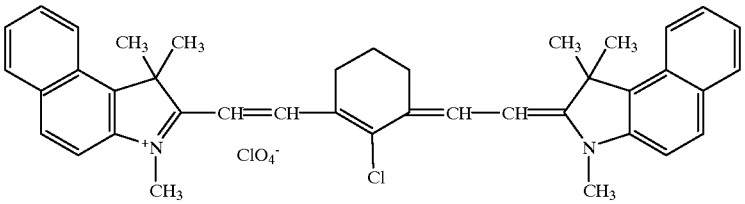

These dyes can be obtained by a conventional synthetic method, and the following commercially available dyes can be used:

IR750 (antraquinone type); IR002 and IR003 (aluminum type), IR820 (polymethine type); IRG022 and IRG033 (diimmonium type); CY-2, CY-4, CY-9 and CY-20, each produced by Nihon Kayaku Co., Ltd.;

KIR103 and SIR103 (phthalocyanine type); KIR101 and SIR114 (antraquinone type); PA1001, PA1005, PA1006 and SIR128, (metal complex type), each produced by Mitsui Toatsu Co., Ltd.;

Fatogen Blue 8120 produced by Dainihon Ink Kagaku Co., Ltd.; and

MIR-101,1011, and 1021 each produced by Midori Kagaku Co., Ltd.

Other infrared dyes are sold by Nihon Kankoshikiso Co., Ltd., Sumitomo Kagaku Co., Ltd. or Fuji Film Co., Ltd.

In the invention, the content of the infrared absorber in the light sensitive composition of the invention is preferably 0.5 to 10% by weight based on the total weight of solid components of the light sensitive composition.

Binder

A binder can be used in the light sensitive composition of the invention. A polymer binder can be used as the binder. The binder includes a novolak resin, a polyhydroxystyrene, a polymer containing a structural unit represented by formula (5) described later, and another conventional acryl resin.

The novolak resin includes a phenol.formaldehyde resin, a cresol.formaldehyde resin, a phenol.cresol.formaldehyde resin disclosed in Japanese Patent O.P.I. Publication No. 55-57841/1980 and a polycondensation resin of a p-substituted phenol or phenol and cresol with formaldehyde.

The polyhydroxystyrene includes a homopolymer or copolymer of hydroxystyrene disclosed in Japanese Patent Publication No. 52-41050/1977.

The polymer containing a structural unit represented by formula (5) includes a homopolymer containing only the structural unit represented by formula (5) and a copolymer containing the structural unit represented by formula (5) and a monomer unit formed by cleavage of a polymerizable double bond of another vinyl monomer.

formula (5)

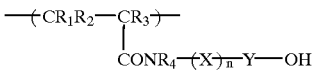

wherein $R_1$ and $R_2$ independently represent a hydrogen atom, an alkyl group such as methyl or ethyl or a carboxyl group, and preferably a hydrogen atom; $R_3$ represents a hydrogen atom, a halogen atom such as chlorine or bromine or an alkyl group such as methyl or ethyl, and preferably a hydrogen atom or methyl; $R_4$ represents a hydrogen atom, an alkyl group such as methyl, an aryl group such as a phenyl group or a naphthyl group; Y represents a substituted or unsubstituted phenylene or naphthylene group, the substituent including an alkyl group such as methyl or ethyl, a halogen atom such as chlorine or bromine; a carboxyl group, an alkoxy group such as methoxy or ethoxy, a hydroxy group, a sulfonic acid group, a cyano group, a nitro group or an acyl group, and preferably a unsubstituted phenylene or naphthylene group or a methyl substituted phenylene or naphthylene group; X represents an organic divalent linkage group; and n is an integer of 0 to 5, and n is preferably 0.

The polymer having a structural unit represented by formula (5) includes polymers represented by the following formulas (a) through (f):

formula (5)

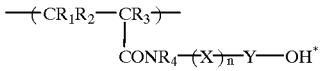

(a)

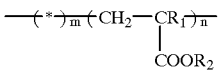

m:n = 30:70

(b)

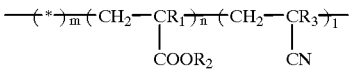

m:n:l = 30:40:30

(c)

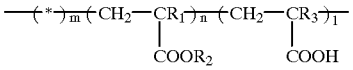

m:n:l = 30:60:10

(d)

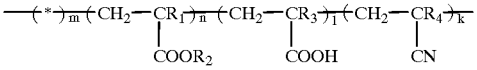

m:n:l:k = 30:30:10:30

(e)

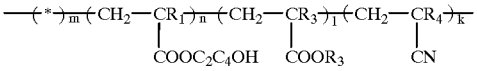

m:n:l:k = 25:5:40:30

-continued formula (5)

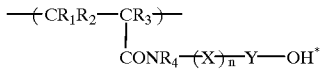

(f)

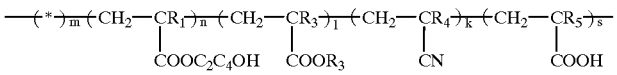

m:n:l:k:s = 30:5:30:30:5

In formulas (a) through (f), $R_1$ through $R_5$ independently represent a hydrogen atom, an alkyl group or a halogen atom; and m, n, l, k and s independently represent mol%.

The novolak resin, polyhydroxystyrene, polymer having a structural unit represented by formula (5) and another conventional acryl resin can be used in combination.

In the invention, the binder content of the light sensitive composition is preferably 20 to 90% by weight, and more preferably 30 to 80% by weight, based on the solid components of the light sensitive composition.

The preferable embodiments in the invention include those comprising the novolak resin, and the polymer having a monomer unit from formula (5) or other acryl resins. The acryl resin includes a polymer having a monomer unit from acrylic acid, methacrylic acid or their ester. The novolak resin content is preferably 20 to 80% by weight based on the solid components of the light sensitive composition of the invention. The content of the polymer having a monomer unit from formula (5) or other acryl resins is preferably 1 to 50% by weight, and more preferably 5 to 30% by weight, based on the solid components of the light sensitive composition of the invention.

Another preferable embodiment in the invention include those comprising the novolak resin and a nonionic surfactant. The nonionic surfactant includes polyoxyethylene alkylether, polyoxyethylene alkylarylether, polyoxyethylene derivatives, oxyethylene-oxypropylene block polymer, sorbitan fatty acid ester, polyoxyethylene sorbitan fatty acid ester, polyoxyethylene sorbitol fatty acid ester, glycerin fatty acid ester, polyoxyethylene fatty acid ester, polyoxyethylene alkylamine, alkylalkanol amide, and polyethylene glycol. In this case, the novolak resin content is preferably 20 to 80% by weight based on the solid components of the light sensitive composition used, and the nonionic surfactant content is preferably 0.01 to 10% by weight, and more preferably 0.1 to 1.0% by weight, based on the solid components of the light sensitive composition used.

From the viewpoint of preventing occurrence of stains on non-image area in course of time, it is preferable that the light sensitive composition contains a fluorine-containing surfactant in an amount of 0.001 to 5 wt %.

As the fluorine-containing surfactant, the following compounds, for example, are given.

$C_7F_{15}CO_2NH_4$, $C_8F_{17}SO_2N(C_2H_5)CH_2COOK$, $C_8F_{17}SO_2NHC_3H_6N^+(CH_3)_2Cl^-$, $C_7F_{15}CONH(CH_2)_3N^+(CH_3)_2C_2H_4COO^-$, $C_8F_{17}SO_2N(C_2H_5)C_2H_4(OC_3H_6)_5OH$, $C_7F_{15}CONHC_3H_6N^+(CH_3)_2(CH_2)_2COO^-$,

-continued

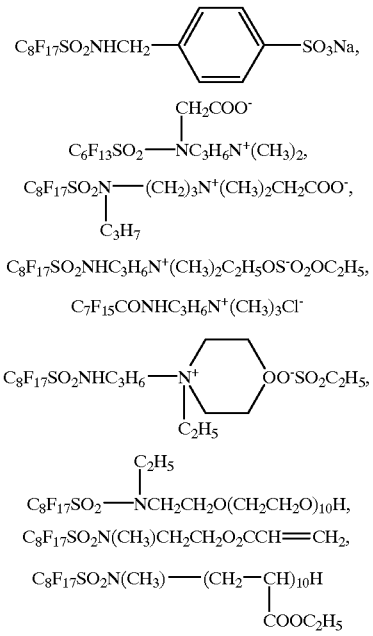

With regard to the fluorine-containing surfactant, it is also possible to use those available on the market, and examples of them include, Surfron "S-381", "S-382", "S-383", "SC-101", "SC-102", "SC-103", "SC-104"(each made by Asahi Glass Co.), Fluorad "FC-430" "FC-431", "FC-173" (each made by Fluorochemical-Sumitomo 3M Co.), Eftop "EF 352", "EF 301", "EF 303" (each made by Shin-Akita Kasei Co.), Schwegolfer "8035", "8036" (each made by Schwegman Co.), "BM1000", "BM1100" (each made by B.M. Hymie Co.), and Megafac "F-171", Megafac "F-177" (each made by Dainihon Ink Kagaku Co.).

The fluorine-containing surfactant content of the light sensitive composition in the invention is preferably 0.05 to 2 wt %, and more preferably 0.1 to 1 wt %, based on the solid components of the light sensitive composition used. The fluorine-containing surfactant can be used either independently or in combination of two or more kinds thereof.

The light sensitive layer of the image forming material of the invention may contain a lipophilic resin to increase lipophilicity of the layer. The lipophilic resin includes a polycondensate of phenols with an alkyl group having 3 to 15 carbon atoms with aldehydes, for example, a t-butylphenol.formaldehyde resin disclosed in Japanese Patent O.P.I. Publication No. 50-125806/1975. The light sensitive layer in the image forming material of the invention may optionally contain dyes, pigment, sensitizers or visualizing agents other than the dyes described above.

The total solid content in the light sensitive composition of the invention is preferably 7 to 15% by weight, and more preferably 8 to 13% by weight.

(2) Image Forming Material

The image forming material of the invention comprises a support and provided thereon, a light sensitive layer containing the light sensitive composition described above. The image forming material is obtained by coating the light sensitive composition (the coating solution containing the solvent in the invention) on the support and drying to form a light sensitive layer.

In the invention, the residual solvent content of the light sensitive layer is preferably 5 mg/m$^2$ or less, more preferably 0.01 to 5 mg/m$^2$, and still more preferably 0.01 to 3 mg/m$^2$. The residual solvent content herein referred to implies the residual amount in the light sensitive layer of at least one of the first solvent with a viscosity of 1.5 cp or more and the second solvent with a viscosity of less than 1.5 cp, which are employed for coating solvents of the light sensitive layer.

In the invention, the residual solvent content is measured according to the following method:

Twenty-five square centimeters of the image forming material are introduced in a 10 ml Bayer's bottle, and tightly closed to obtain a sample for measuring the residual solvent content. The residual solvent content of the resulting sample is measured according to gas chromatography, employing HP 5890 SERIES II GC (produced by HEWLETT PACKARD Co. Ltd.), in which Column DB-WAX (30 m×1.0 mmid) and a detector FID are provided, under conditions of carrier gas, He 20 ml/min., and injection: 250° C.

The support, on which the light sensitive layer is provides, includes a metal plate such as aluminum, zinc, steel or copper, a metal plate, paper sheet, plastic film or glass plate which is plated or vacuum evaporated with chromium, zinc, copper, nickel, aluminum or iron, a paper sheet coated with a resin, a paper sheet laminated with a metal foil such as aluminum and a plastic film subjected to hydrophilic treatment.

When the invention is applied to a presensitized planographic printing plate, the support is preferably an aluminum plate which is subjected to a surface treatment such as graining treatment, anodizing treatment or sealing treatment. The surface treatment is carried out by a conventional method.

The graining treatment includes a mechanically graining method and an electrolytically etching method. The mechanically graining method includes a ball graining method, a brush graining method, a liquid horning graining method and a buff graining method. The above methods can be used singly or in combination according to an aluminum material composition. The electrolytically etching is carried out in a bath containing one or more of phosphoric acid, sulfuric acid, hydrochloric acid and nitric acid. After graining, the surface of the support is optionally subjected to desmut treatment using an alkaline or acid solution to neutralize and washed with water.

The anodizing is carried out by electrolyzing the surface of the aluminum support using the aluminum plate as an anode in a solution containing one or more of sulfuric acid, chromic acid, oxalic acid, phosphoric acid and malonic acid. The thickness of the anodizing film formed is suitably 1 to 50 mg/dm$^2$, preferably 10 to 40 mg/dm$^2$, and more preferably 25 to 40 mg/dm$^2$. The thickness of the anodizing film is obtained by immersing the anodized aluminum in a solution containing phosphoric acid and chromic acid (water is added to 35 ml of 85% phosphoric acid and 20 g of chromium (IV) oxide to make a 1 liter solution) to dissolve the anodized film and measuring the aluminum weight before and after the immersing.

The sealing is carried out by treating the aluminum support with a boiling water, steam, a sodium silicate solution or a dichromic acid solution.

(3) Manufacturing Method of Image Forming Material

In the invention, a presensitized planographic printing plate, which is one embodiment of the image forming material of the invention, is manufactured by coating the above described light sensitive composition on an aluminum support, and then drying the coated at 85° C. or more for 10 seconds or more, preferably at 90° C. or more for 30 seconds or more to form a light sensitive layer having a residual solvent content of 5 mg/m$^2$ or less.

The coating method includes conventional coating methods such as a whirler coating method, a wire-bar coating method, a dip coating method, an air-knife coating method, a blade coating method and a curtain coating method. The coating amount of the light sensitive layer in the presensitized planographic printing plate is preferably 0.5 to 5.0 g/m$^2$, although it varies depending on the usage.

The image forming material of the invention is preferably imagewise exposed to light having a wavelength of 700 nm or more. The light source emitting such a light includes a semiconductor laser, a He-Ne laser, a YAG laser, and a carbon dioxide laser. The output power is suitably 50 mW or more, and preferably 100 mW or more.

The image forming material of the invention is developed with a developer, preferably an aqueous alkaline developer. The aqueous alkaline developer includes an aqueous solution containing an alkali metal salt such as sodium hydroxide, potassium hydroxide, sodium carbonate, potassium carbonate, sodium metasilicate, potassium metasilicate or di or trisodium phosphate. The metal salt concentration of the developer is preferably 0.05 to 20% by weight, and more preferably 0.1 to 10% by weight. The developer optionally contains an anionic surfactant, an amphoteric surfactant or an organic solvent such as alcohol. The organic solvent includes propylene glycol, ethylene glycol monophenylether, benzyl alcohol and n-propyl alcohol.

EXAMPLES

Next, the present invention will be explained in the examples. In the examples or comparative examples, all "parts" are by weight, unless otherwise specified.

Example 1

Preparation of a Support

A 0.24 mm thick aluminum plate (material 1050, quality H16) was degreased at 65° C. for one minute in a 5% sodium hydroxide solution, washed with water, neutralized in a 10% sulfuric acid solution at 25° C. for one minute and further washed with water. The resulting plate was electrolytically etched at 25° C. for 60 seconds at an alternating current density of 10 A/dm$^2$ in a 1.0% nitric acid solution, desmut at 60° C. for 10 seconds in a 5% sodium hydroxide solution, and then anodized at 20° C. for one minute at a current density of 3 A/dm$^2$ in a 20% sulfuric acid solution. The resulting aluminum plate was immersed at 80° C. for 30 seconds in a 15% ammonium acetate solution, washed with water and dried at 80° C. for 3 minutes. The resulting plate was further immersed at 85° C. for 30 seconds in a 0.1 weight % carboxymethyl cellulose (CMC) solution, and dried at 85° C. for 5 minutes. Thus, support 1 was obtained.

Synthesis of Acid Decomposable Compound A

A mixture of 0.5 mol of 1,1-dimethoxycyclohexane, 1.0 mol of 2-phenoxyethanol, 80 mg of p-toluene sulfonic acid and 300 ml of toluene was reacted at 120° C. for 8 hours with stirring, while methanol produced during reaction was removed. The reaction mixture solution was cooled, washed with water, an aqueous sodium hydroxide solution, washed with an aqueous saturated sodium chloride solution to be neutralized, and dried over anhydrous potassium carbonate. The solvent (toluene) of the resulting solution was removed by evaporation under reduced pressure to obtain white crystals. Thus, an acid decomposable compound A represented by the formula described later was obtained.

Preparation of Light Sensitive Composition 1

Light sensitive composition 1 having the following composition was prepared.

| | |
|---|---|
| Binder A (copolycondensate of phenol, m-cresol and p-cresol with formaldehyde, phenol/ m-cresol/p-cresol = 5/57/38 by molar ratio, Mw = 3700) | 60.75 parts |
| Binder B (represented by the formula described later, Molecular weight = 3800) | 15 parts |
| Acid decomposable compound A | 20 parts |
| Acid generating compound (Exemplified compound (1)) | 3 parts |
| Cyanine dye (Exemplified infrared absorber IR-25) | 1 part |
| Surfactant S-381 (produced by Asahi Glass Co. Ltd.) | 0.25 part |
| * Mixed solvent (** PGM (viscosity: 1.75 cp)/MEK (viscosity: 0.42 cp) = 7/3, by weight ratio) | 1000 parts |

* The sp value of the above mixed solvent was 9.86.

** PGM is propylene glycol monomethylether, and MEK is methyl ethyl ketone.

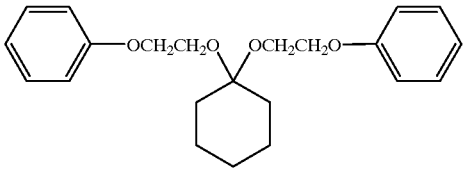

Binder B (n:m:o:p=36.5:3.5:30:30, by molar ratio)

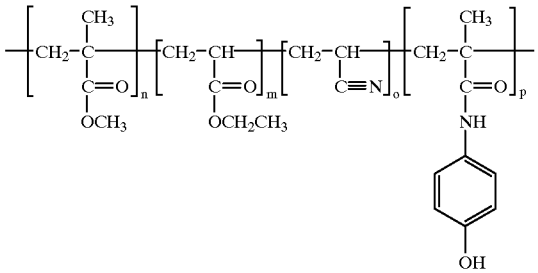

Preparation of Image Forming Material

The above light sensitive composition 1 was coated on support 1 obtained above with a wire bar, and dried at 95° C. for 90 seconds to obtain a light sensitive layer with a dry thickness of 2.0 g/m$^2$. Thus, an image forming material sample (hereinafter referred to as presensitized planographic printing plate 1) was prepared. The residual solvent content of the light sensitive layer is 2 mg/dm$^2$.

Presensitized planographic printing plate 1 was imagewise exposed to a semiconductor laser (having a wavelength of 830 nm and an output of 500 mW). The laser light spot diameter was 13 $\mu$m at 1/e$^2$ of the peak intensity. The resolving degree was 2,000 dpi in both the main and the sub scanning directions. The exposed plate was developed at 30° C. in 30 seconds with developer, in which a planographic printing plate developer, SDR-1 (produced by Konica Corporation) was diluted 6 times by volume with water, to remove non-image portions (exposed portions), washed with water, and dried. Thus, printing plate 1 having a positive image was obtained.

Evaluation

Sensitivity

Sensitivity was represented in terms of exposure energy (mJ/cm$^2$) necessary to form an image when a presensitized planographic printing plate was exposed and then developed under the above conditions.

Chemical Resistance

The developed plate was immersed at 25° C. in Ultra Plate Cleaner (produced by Dainichi Seika Co., Ltd.), a chemical used during printing, for 15, 30 and 60 minutes, and washed with water. The image portions after the immersing was visually observed at each immersing time, as compared to those before the immersing, and evaluated according to the following criteria:

5: No damage at image portions

4: Some image portions were slightly damaged, but no problem.

3: Image portions were slightly damaged, but not so damaged that the image portions were removed to expose the surface of the support.

2: Some image portions were removed to partially expose the surface of the support.

1: Image portions were completely removed to expose the surface of the support.

Example 2

Preparation of Light Sensitive Composition 2

Light sensitive composition 2 having the following composition was prepared.

| | |
|---|---|
| Binder A (copolycondensate of phenol, m-cresol and p-cresol with formaldehyde, phenol/ m-cresol/p-cresol = 5/57/38 by molar ratio, Mw = 3700) | 60.75 parts |
| Binder B (represented by the formula described later, Molecular weight = 3800) | 15 parts |
| Acid cross-linkable resin, resol resin Shonol CKP-918 produced by Showa Kobunshi Co., Ltd.) | 35.75 parts |
| Acid generating compound (Exemplified compound (1)) | 3 parts |
| Cyanine dye (Exemplified infrared absorber IR-25) | 1 part |
| Surfactant S-381 (produced by Asahi Glass Co. Ltd.) | 0.25 part |
| * Mixed solvent (PGM (viscosity: 1.75 cp)/MEK(viscosity: 0.42 cp) = 7/3 by weight) | 1000 parts |

* The sp value of the above mixed solvent was 9.86.

Preparation of Image Forming Material

The above light sensitive composition 2 was coated on Support 1 obtained above with a wire bar, and dried at 95° C. for 90 seconds to obtain a light sensitive layer with a dry thickness of 2.0 g/m$^2$. Thus, an image forming material sample (hereinafter referred to as presensitized planographic printing plate 2) was prepared. The residual solvent content of the light sensitive layer is 2.2 mg/dm$^2$.

Presensitized planographic printing plate 2 was imagewise exposed to a semiconductor laser (having a wavelength of 830 nm and an output of 500 mW). The laser light spot diameter was 13 $\mu$m at $1/e^2$ of the peak intensity. The resolving degree was 2,000 dpi in both the main and the sub scanning directions. The exposed plate was developed at 30° C. in 30 seconds with developer, in which a planographic printing plate developer, SDR-1 (produced by Konica Corporation) was diluted 6 times by volume with water, to remove non-image portions (non-exposed portions), washed with water, and dried. Thus, printing plate 2 having a negative image was obtained. The developed plate 2 was evaluated in the same manner as in Example 1.

Examples 3, 5, 7, 9, and 11

Presensitized planographic printing plates 3, 5, 7, 9, and 11 were prepared in the same manner as in Example 1, except that mixed solvents as shown in Table 1 were used and drying was carried out under conditions as shown in Table 1. The resulting plates was exposed, and developed in the same manner as in Example 1, and the developed plates were evaluated in the same manner as in Example 1.

Examples 9, and 11 were comparative examples.

Examples 4, 6, 8, 10, and 12

Presensitized planographic printing plates 4, 6, 8, 10, and 12 were prepared in the same manner as in Example 2, except that mixed solvents as shown in Table 1 were used and drying was carried out under conditions as shown in Table 1. The resulting plates was exposed, and developed in the same manner as in Example 1, and the developed plates were evaluated in the same manner as in Example 1.

Examples 10, and 12 were comparative examples.

The results are shown in Table 1.

What is claimed is:

1. A light sensitive composition containing a compound capable of generating an acid on exposure of an actinic light, a compound having a chemical bond capable of being decomposed by an acid or a compound having a group cross-linking by an acid, an infrared absorber, a binder and a solvent mixture of a first solvent with a viscosity of 1.5 cp or more and a second solvent with a viscosity of less than 1.5 cp, wherein the binder comprises novolak resin and a polymer containing a structural unit represented by formula (5);

formula (5)

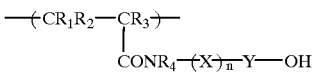

wherein $R_1$ and $R_2$ independently represent a hydrogen atom, an alkyl group or a carboxyl group; $R_3$ represents a hydrogen atom, a halogen atom or an alkyl group; $R_4$ represents a hydrogen atom an alkyl group, an aryl group or a naphthyl group; Y represents a substituted or unsubstituted phenylene or naphthylene group; X represents a divalent linkage group; and n is an integer of 0 to 5.

2. The light sensitive composition of claim 1, wherein the first solvent has a viscosity of 1.5 cp to 4.0 and the second solvent has a viscosity of less than 0.5 to 1.5 cp.

3. The light sensitive composition of claim 1, wherein the solvent mixture has a solubility parameter, sp value of 8.0 or more.

4. The light sensitive composition of claim 3, wherein the solubility parameter, sp value of the solvent mixture is 8.5 to 12.0.

5. The light sensitive composition of claim 3, wherein the solubility parameter, sp value of the solvent mixture is 9.0 to 11.5.

TABLE 1

| | Mixed solvent | | | Drying temperature (° C.) and time (seconds) | | Residual Solvent content | SDR-1/water = 1/5 Sensitivity | Chemical resistance | | | |
|---|---|---|---|---|---|---|---|---|---|---|---|
| Example No. | Kind | Viscosity (cp) | sp value | ° C. | time | (mg/dm$^2$) | (mj/m$^2$) | 15 min | 30 min | 60 min | Remarks |
| 1 | PGM/MEK = 7/3 | 1.75/0.42 | 9.86 | 95 | 90 | 2 | 200 | 5 | 5 | 5 | Inv. |
| 2 | PGM/MEK = 7/3 | 1.75/0.42 | 9.86 | 95 | 90 | 2.2 | 200 | 5 | 5 | 4 | |
| 3 | Diacetone alcohol/MEK = 7/3 | 3.2/0.42 | 9.23 | 95 | 90 | 1.6 | 200 | 5 | 5 | 5 | |
| 4 | Diacetone alcohol/MEK = 7/3 | 3.2/0.42 | 9.23 | 95 | 90 | 1.6 | 250 | 5 | 5 | 3 | |
| 5 | Cyclohexanone/MEK = 8/2 | 2.2/0.42 | 9.78 | 95 | 60 | 1.3 | 300 | 5 | 5 | 5 | |
| 6 | Cyclohexanone/MEK = 8/2 | 2.2/0.42 | 9.78 | 95 | 60 | 1.5 | 300 | 5 | 5 | 5 | |
| 7 | Methyl lactate/MEK = 7/3 | 3.87/0.42 | 11.3 | 95 | 90 | 2 | 200 | 5 | 5 | 5 | |
| 8 | Methyl lactate/MEK = 7/3 | 3.87/0.42 | 11.3 | 95 | 90 | 2.1 | 250 | 5 | 5 | 3 | |
| 9 | PGM | 1.75 | 10.1 | 95 | 90 | 2.9 | 300 | 5 | 3 | 1 | Comp. |
| 10 | PGM | 1.75 | 10.1 | 95 | 90 | 3.4 | 200 | 5 | 5 | 1 | |
| 11 | Cyclopentanone/MEK = 7/3 | 1.43/0.43 | 10.1 | 95 | 90 | 1.1 | 300 | 3 | 1 | 1 | |
| 12 | Cyclopentanone/MEK = 7/3 | 1.43/0.43 | 10.1 | 95 | 90 | 1.3 | 400 | 1 | 1 | 1 | |

Inv.: Invention, Comp.: Comparative

As is apparent from Table 1, the positive or negative working image forming material (presensitized planographic printing plate) employing the light sensitive composition of the invention can form an image by infrared ray exposure, and provides high sensitivity to infrared rays, excellent developability, excellent storage stability, and excellent chemical resistance.

6. The light sensitive composition of claim 1, wherein the polymer contains a structural unit represented by formula 5 formula (5)

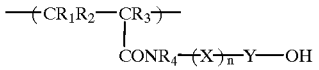

wherein $R_1$ and $R_2$ independently represent a hydrogen atom, an alkyl group or a carboxyl group; $R_3$ represents a hydrogen atom, a halogen atom or an alkyl group; $R_4$ represents a hydrogen atom, an alkyl group, an aryl group or a naphthyl group; Y represents a substituted or unsubstituted phenylene or naphthylene group; X represents a divalent linkage group; and n is 0.

7. An image forming material comprising a support and provided thereon, a light sensitive layer comprising a light sensitive composition containing a compound capable of generating an acid on exposure of an actinic light, a compound having a chemical bond capable of being decomposed by an acid or a compound having a group cross-linking by an acid, an infrared absorber, a binder and a solvent mixture of a first solvent with a viscosity of 1.5 cp or more and a second solvent with a viscosity of less than 1.5 cp, wherein the binder comprises a novolak resin and a polymer containing a structural unit represented by formula (5);

formula (5)

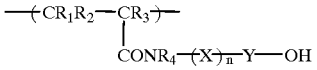

wherein $R_1$ and $R_2$ independently represent a hydrogen atom, an alkyl group or a carboxyl group; $R_3$ represents a hydrogen atom, a halogen atom or an alkyl group; $R_4$ represents a hydrogen atom, an alkyl group, an aryl group or a naphthyl group; Y represents a substituted or unsubstituted phenylene or naphthylene group; X represents a divalent linkage group; and n is an integer of 0 to 5.

8. The image forming material of claim 7, wherein the light sensitive material has a residual solvent content of 5 $mg/m^2$ or less.

9. The image forming material of claim 8, wherein the residual solvent content of the light sensitive layer is 0.01 to 5 $mg/m^2$.

* * * * *